US006322242B1

(12) United States Patent
Lang et al.

(10) Patent No.: US 6,322,242 B1
(45) Date of Patent: Nov. 27, 2001

(54) MULTISTATION COLOR CODED LIQUID MIXING AND DISPENSING APPARATUS

(75) Inventors: Christopher F. Lang, Racine; James H. Lohr, Union Grove, both of WI (US)

(73) Assignee: S. C. Johnson Commercial Markets, Inc., Sturtevant, WI (US)

( * ) Notice: Subject to any disclaimer, the term of this patent is extended or adjusted under 35 U.S.C. 154(b) by 0 days.

(21) Appl. No.: 09/615,348

(22) Filed: Jul. 12, 2000

(51) Int. Cl.[7] ..... B01F 5/04
(52) U.S. Cl. ..... 366/163.2; 222/132
(58) Field of Search ..... 366/162.1, 163.1, 366/163.2, 177.1, 142; 222/132, 133; 137/888, 889, 892–894, 896

(56) References Cited

U.S. PATENT DOCUMENTS 3,460,717 * 8/1969 Thomas .
4,934,651 6/1990 Nowicki .
4,998,850 * 3/1991 Crowell .
5,044,522 * 9/1991 Roig et al. .
5,123,449 6/1992 Nowicki .
5,141,016 8/1992 Nowicki .
5,174,503 * 12/1992 Gasaway .
5,259,557 * 11/1993 Spriggs et al. .
5,927,338 * 7/1999 Boticki et al. ..... 137/888

* cited by examiner

*Primary Examiner*—Charles E. Cooley
(74) *Attorney, Agent, or Firm*—Neil E. Hamilton; Warren R. Bovee; Renee J. Rymarz

(57) ABSTRACT

A multistation liquid mixing and dispensing apparatus which substantially reduces the risk of dispensing the wrong product. A color-coded system is employed which color-coordinates the container with a chemical concentrate to the components of the mixing and dispensing apparatus. An eductor is employed to mix the chemical concentrate with a diluting liquid. The mixing and dispensing apparatus is particularly suited for mixing and dispensing cleaning products used in maintaining large institutional buildings, such as stores and offices.

8 Claims, 8 Drawing Sheets

MULTISTATION COLOR CODED LIQUID MIXING AND DISPENSING APPARATUS

CROSS-REFERENCE TO RELATED APPLICATIONS

None

STATEMENT REGARDING FEDERALLY SPONSORED RESEARCH OR DEVELOPMENT

None

BACKGROUND OF THE INVENTION

1. Technical Field

This invention relates generally to liquid handling and more particularly, to combining and dispensing multiple liquids in a manner that improper usage is substantially reduced.

2. Background Art

In the maintenance of large buildings such as office buildings or stores in shopping centers, it is customary to mix the required cleaning agents from a source of concentrate with water. The resulting solutions are then filled into suitable containers such as bottles or buckets. An apparatus of this type is available from Johnson Wax Professional of Sturtevant, Wis, as the Quattro SS Solutions Center.

While the previously described unit affords accurate, reliable and safe dispensing of solutions, it requires the placement of bottles to be filled at an angle and in an elevated position. It would be desirable to have such an apparatus wherein the bottles could be filled in a more convenient manner.

There is a dispensing solution apparatus available from The Butcher Company which places a container with concentrate above an eductor. There is also a dispensing solution apparatus from the 3-M Company which places the container with the concentrate above the dispensing mechanism. However, in the two aforementioned dispensing units only a single container for concentrate is employed.

The objects of the invention therefore are:

a. Providing an improved liquid mixing and dispensing apparatus.

b. Providing a liquid mixing and dispensing apparatus which allows for easier filling of containers.

c. Providing a liquid mixing and dispensing apparatus which substantially reduces the risk of improper usage.

d. Providing a liquid mixing and dispensing apparatus of the foregoing type which is easily maintained.

e. Providing a liquid mixing and dispensing apparatus of the foregoing type which can accommodate a variety of container sizes.

SUMMARY OF THE INVENTION

The foregoing objects are accomplished and the shortcomings of the prior art are overcome by the multistation liquid mixing and dispensing apparatus of the invention which includes a support member and a plurality of containers placed on the support member. There are a plurality of valve members and eductors positioned below the containers. A liquid intake manifold is connected to the valve members and the eductors. A liquid product supply line is operatively connected to each container, and a liquid product intake of the eductor. A cap member is connected to each container and the liquid supply line. A liquid outlet line is operatively connected to each eductor. Each of the containers, cap members, valve members and liquid outlet lines are color-coded.

In one aspect, the containers have labels which are color coded to the cap members, valve members and liquid outlet lines.

In another aspect, the liquid outlet lines are flexible hoses of different colors.

In still another aspect, one of the liquid outlet lines is of a longer length than the others.

In yet another aspect the support member includes color-coded labels which match the color-coded cap members, valve members and liquid outlet lines.

In a preferred embodiment, the support member is defined by an open shelf.

In another preferred embodiment, a panel member supports the eductor and the valve members with the valve members extending through the panel for access thereto.

These and still other objects and advantages of the invention will be apparent from the description which follows. In the detailed description below a preferred embodiment of the invention will be described in reference to the full scope of the invention. Rather, the invention may be employed in other embodiments.

DESCRIPTION OF THE PREFERRED EMBODIMENT

Figure 1:
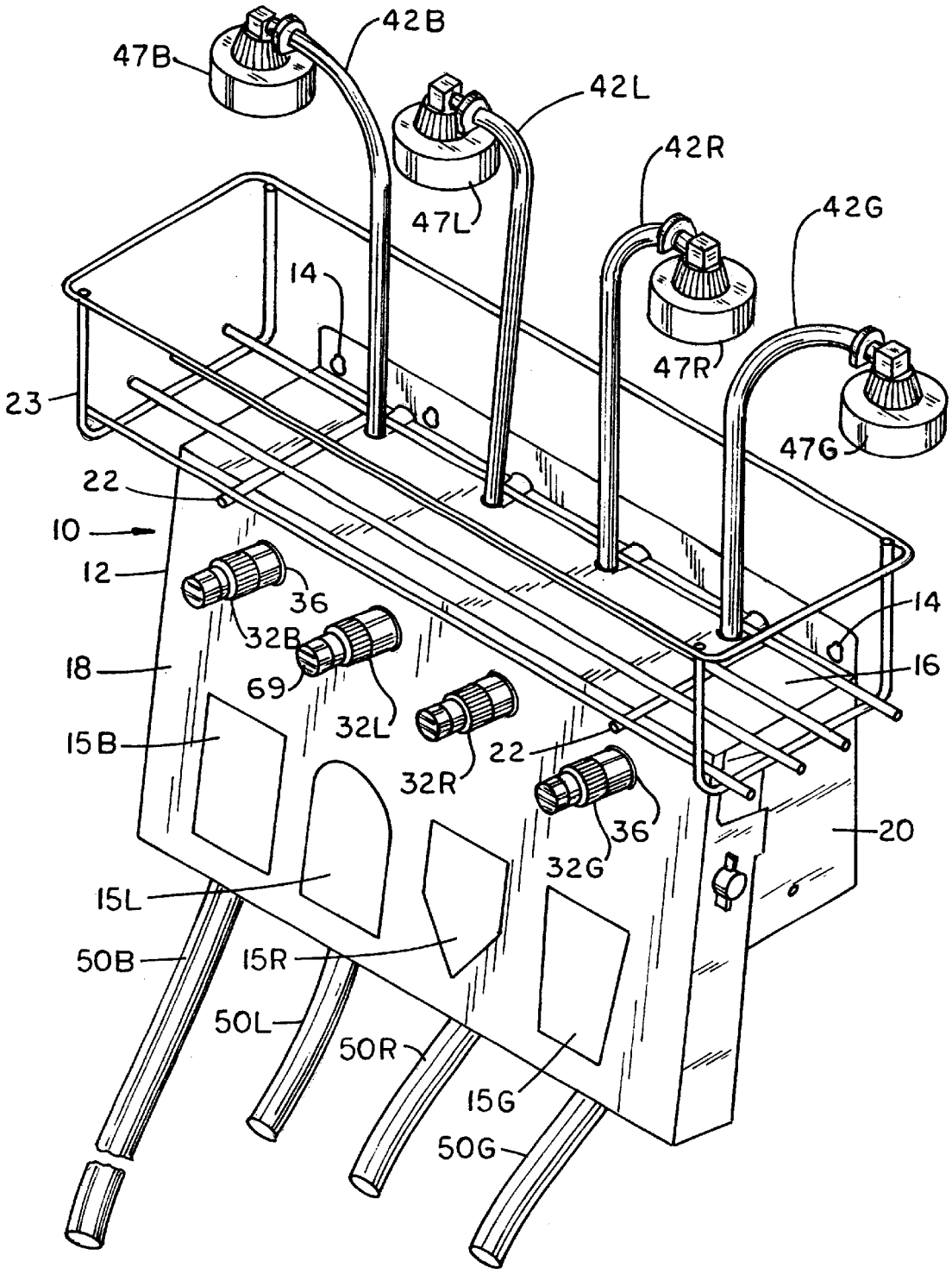
FIG. 1 is a perspective view of the multistation liquid mixing and dispensing apparatus.

Referring to FIGS. 1–3 and 6, the mixing and dispensing apparatus generally 10 includes a housing member 12 composed of an upper panel 16 a front panel 18 and side panels 20 and 21. A rack member 23 is connected to the top of the housing member 12 such as by the wires 22. Containers 24B, 24L, 24R and 24G with labels 26B, 26L, 26R and 26G with concentrated cleaning chemicals are positioned in rack member 23. In this instance and throughout the description, the letters B, L, R and G indicate the colors black, blue, red and green respectively, in conjunction with the reference numerals.

Figure 4:
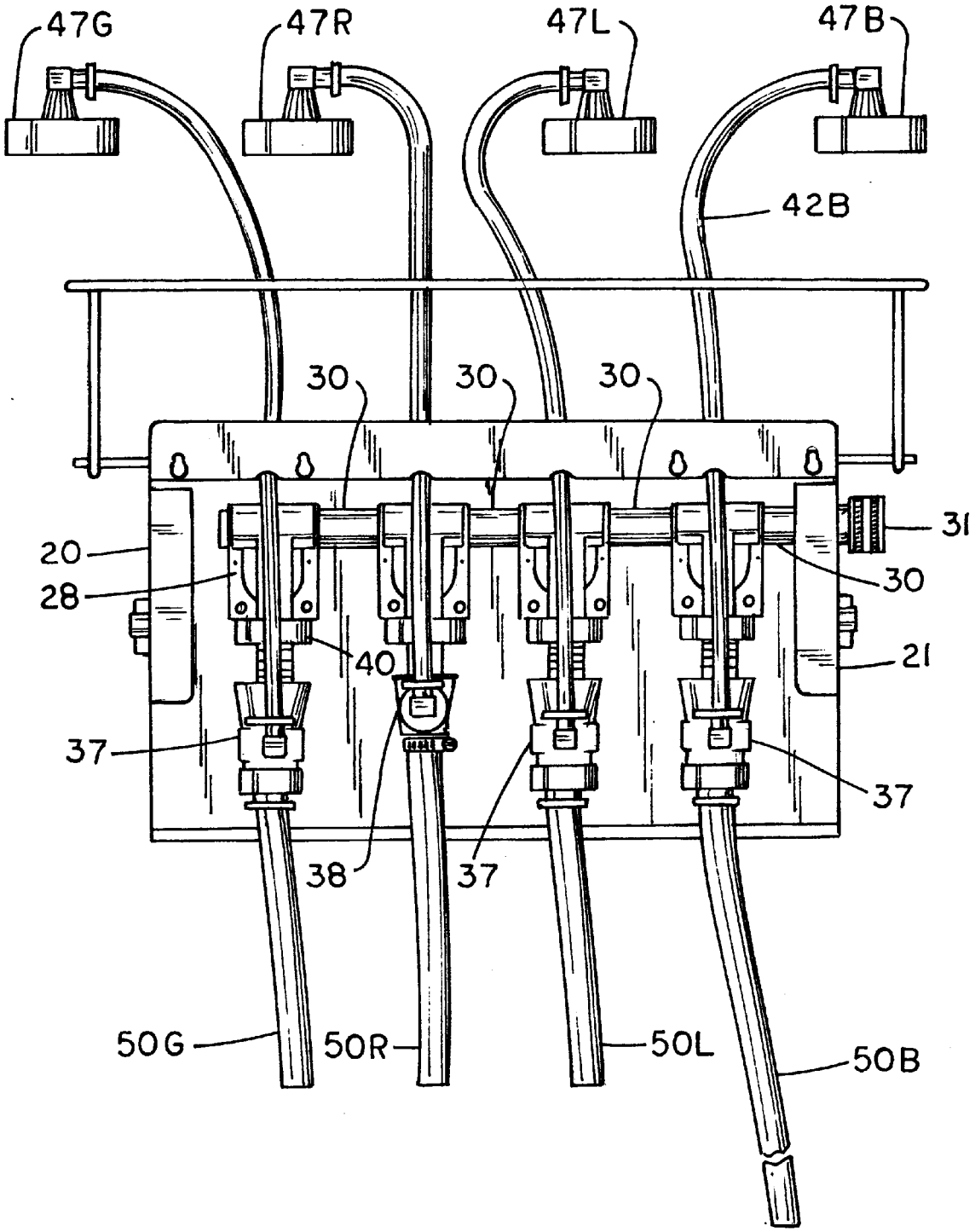
FIG. 4 is a back view of the apparatus shown in FIG. 1.
Figure 5:
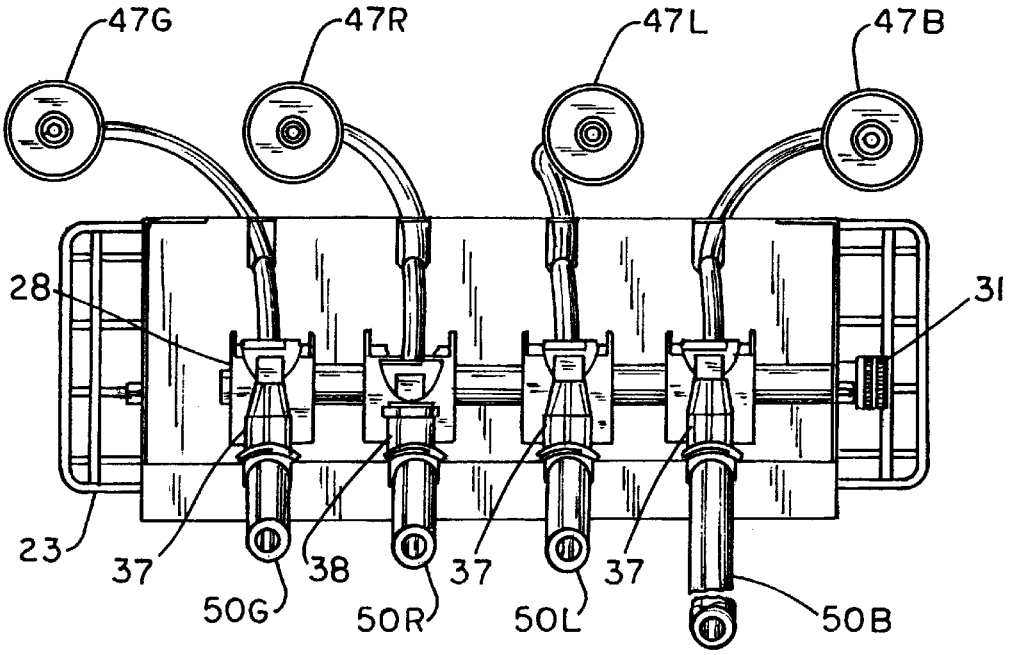
FIG. 5 is a bottom view of the apparatus shown in FIG. 1.
Figure 6:
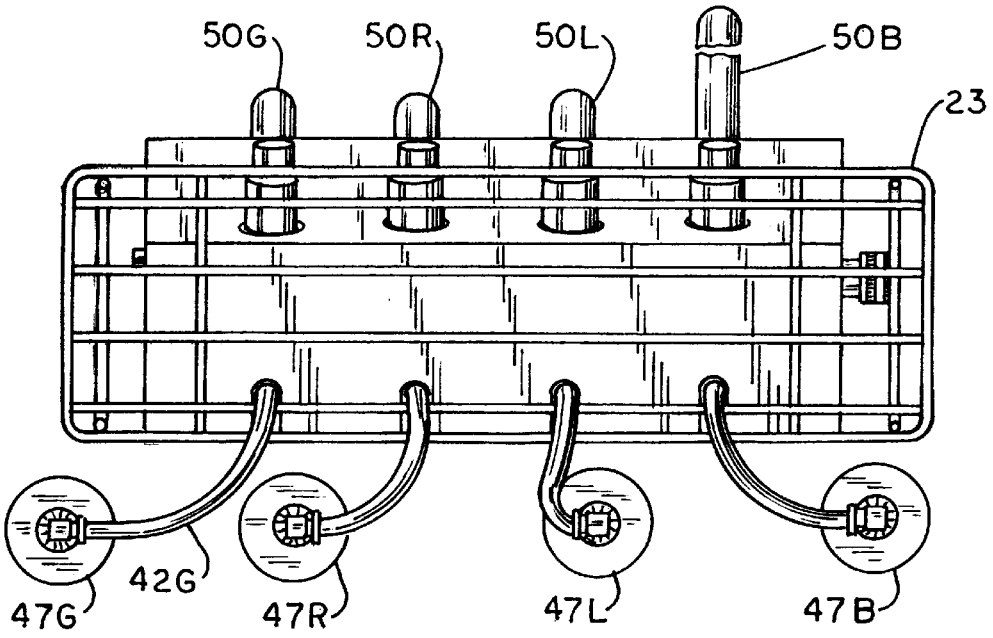
FIG. 6 is a top view of the apparatus shown in FIG. 1.

As seen in FIGS. 4 and 5 there are four valve bodies 28 connected to housing member 12. These valve bodies 28 are interconnected to a source of water such as by the liquid supply lines 30 which provide a manifold and the hose connection 31. As seen in FIG. 1, there are four valve members 32B, 32L, 32R and 32G which are connected to the valve bodies 28 through apertures 36 in the front panel 18 of housing member 12. There are four eductors 37 and 38 also attached to the valve bodies 28 by means of the nuts 40. Liquid supply lines 42B, 42L, 42R and 42G supply liquid concentrate to the eductors 37 and 38 by means of the caps 47B, 47L, 47R and 47G attached to the containers 24B, L, R and G. Outlet lines 50B, 50L, 50R and 50G deliver a mixed solution of water and the contents of the containers 24B, L, R and G to appropriate containers in the instance of lines 50L, R and G. As to line 50B it will have a spray head attached thereto (not shown).

Figure 2:
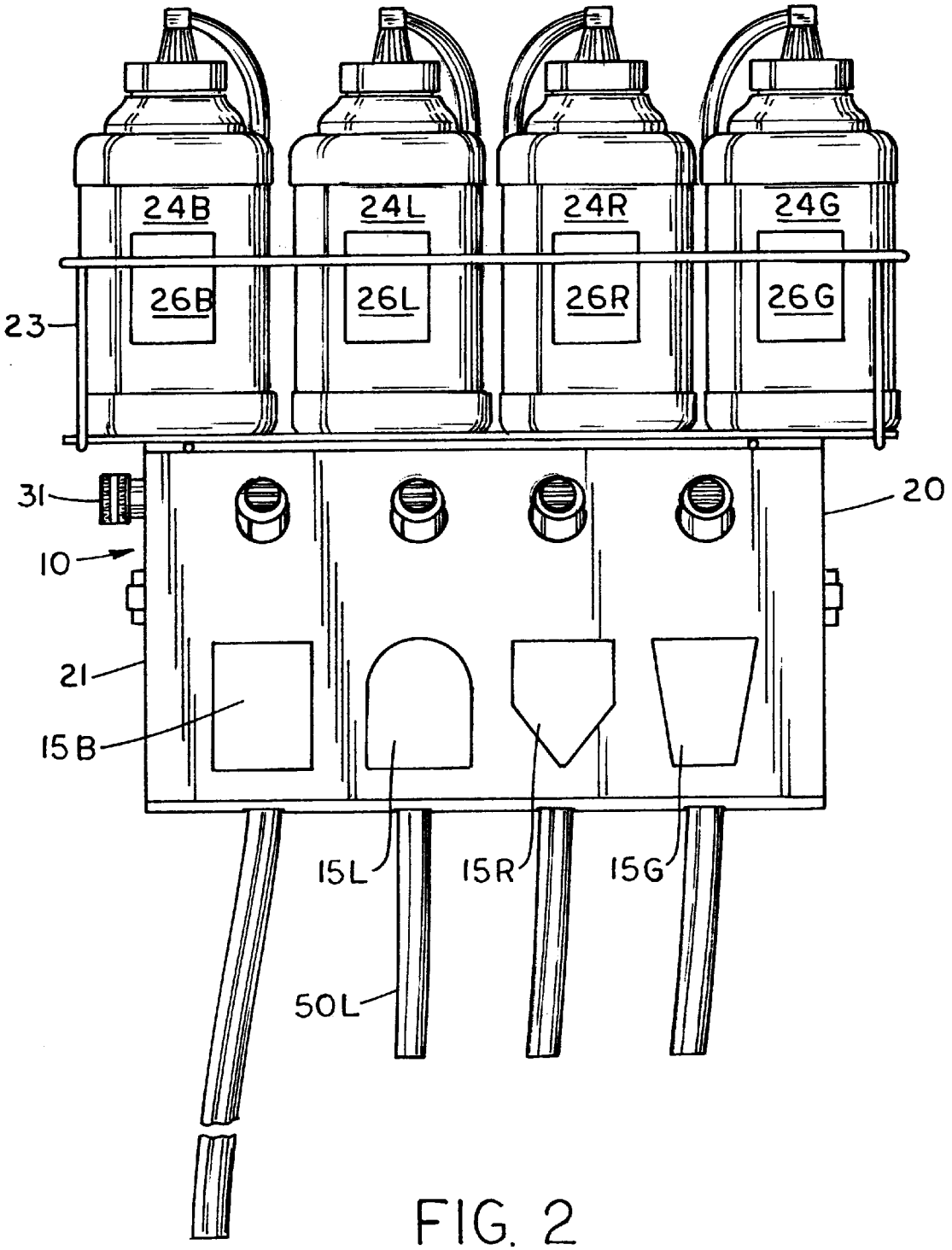
FIG. 2 is a front view of the apparatus shown in FIG. 1.
Figure 3:
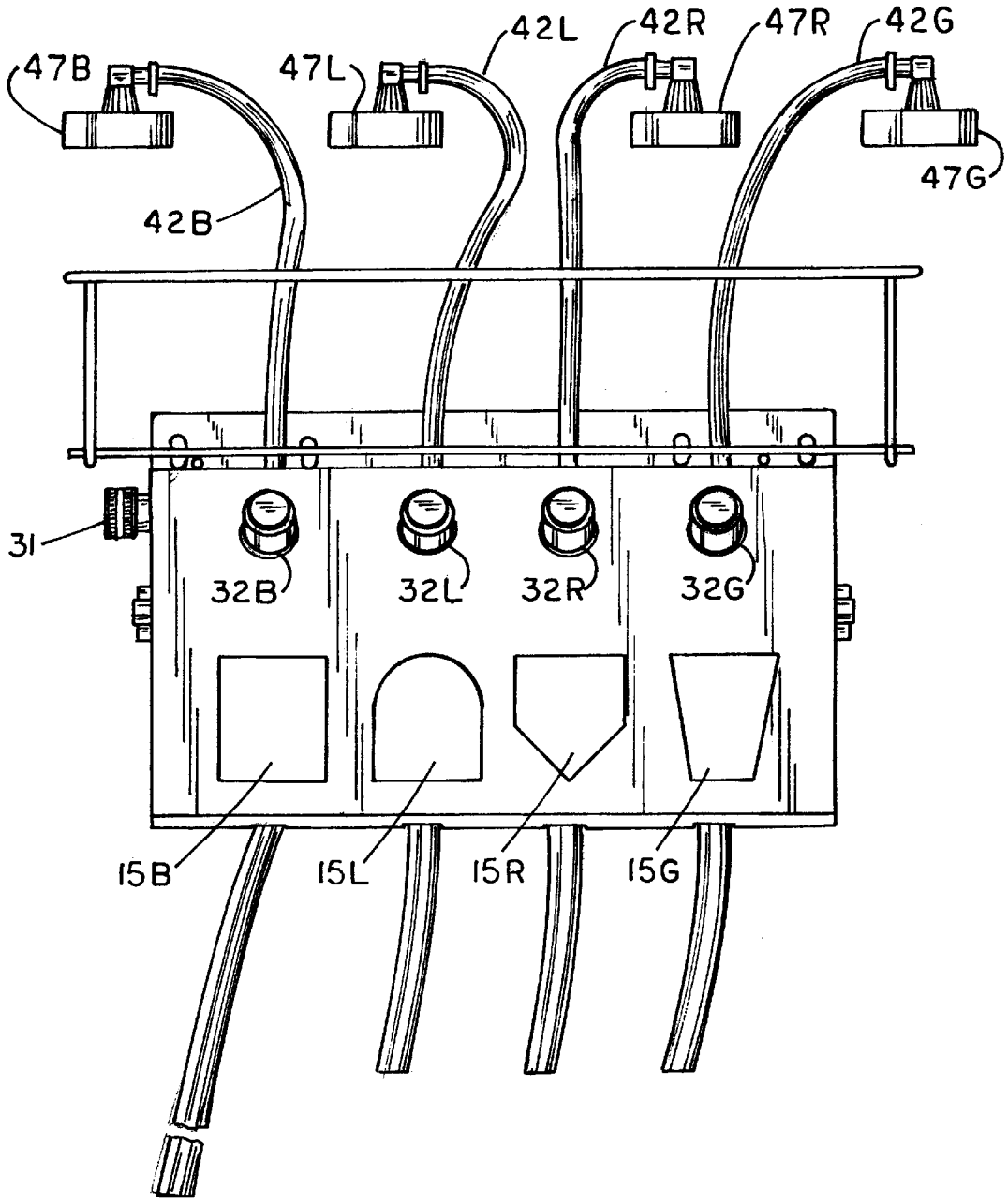
FIG. 3 is a view similar to FIG. 2 but without the concentrate containers.

Referring to FIGS. 1 and 2, disposed on front panel 18 are also product labels 15B, 15L, 15R and 15G. These are of a different geometric configuration as well as color.

Eductors 37 and 38 are described in U.S. Pat. No. 5,927,338, the teachings of which are incorporated herein by reference. Eductors 37 and 38 are available from S. C. Johnson Commercial Markets, Inc., Sturtevant, Wis. The difference between the eductor 38 and eductors 37 is that the dilution rate is much smaller. For example the dilution rate for eductor 38 and the concentrate in the container 24R is 1:6 whereas for the eductor 37 connected to the containers 24B, 24 L and 24G the dilution ratios are 1:512, 1:40 and 1:64 respectively.

Figure 8:
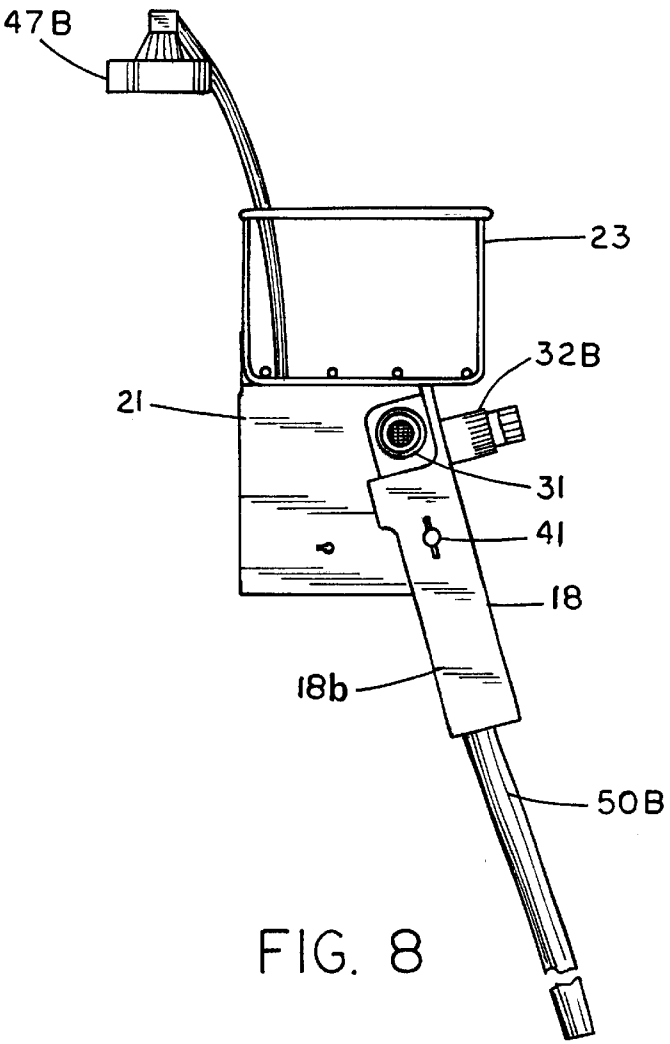
FIGS. 7 and 8 are side views of the apparatus shown in FIG. 1.
Figure 7:
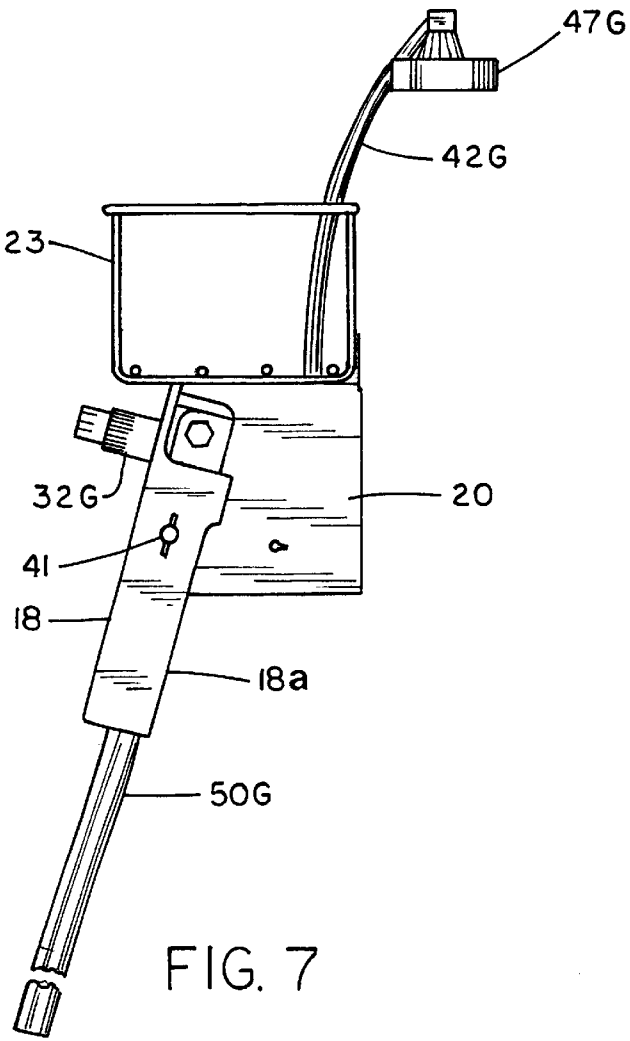

Referring to FIGS. 7 and 8 it is seen that the front panel 18 has side sections 18*a* and 18*b*. These are secured to the side panels 20 and 21, respectively, of the housing member 12 by the wing nuts 41.

Figure 9:
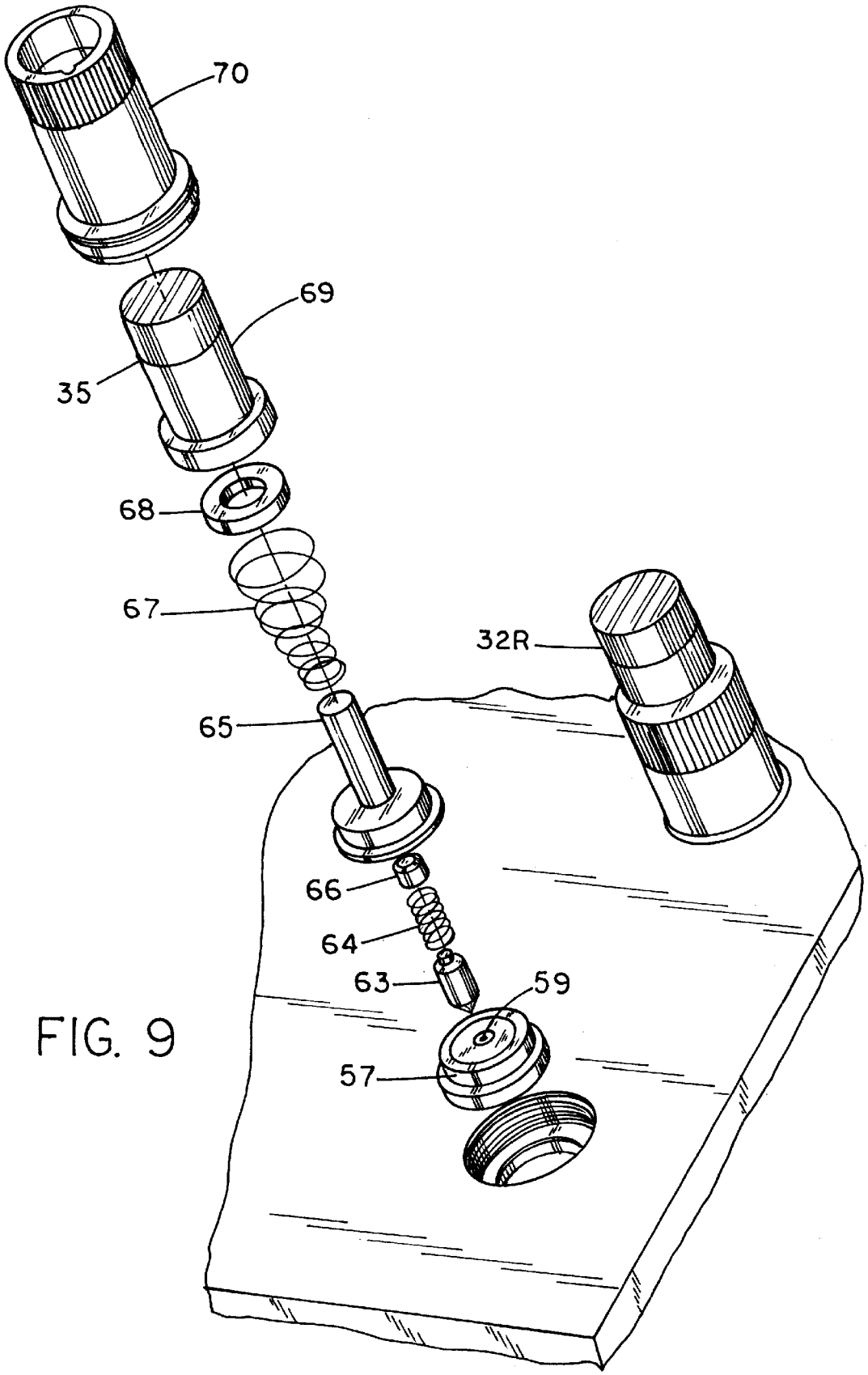
FIG. 9 is an exploded view of a valve member for use in the apparatus of FIG. 1.
Figure 10:
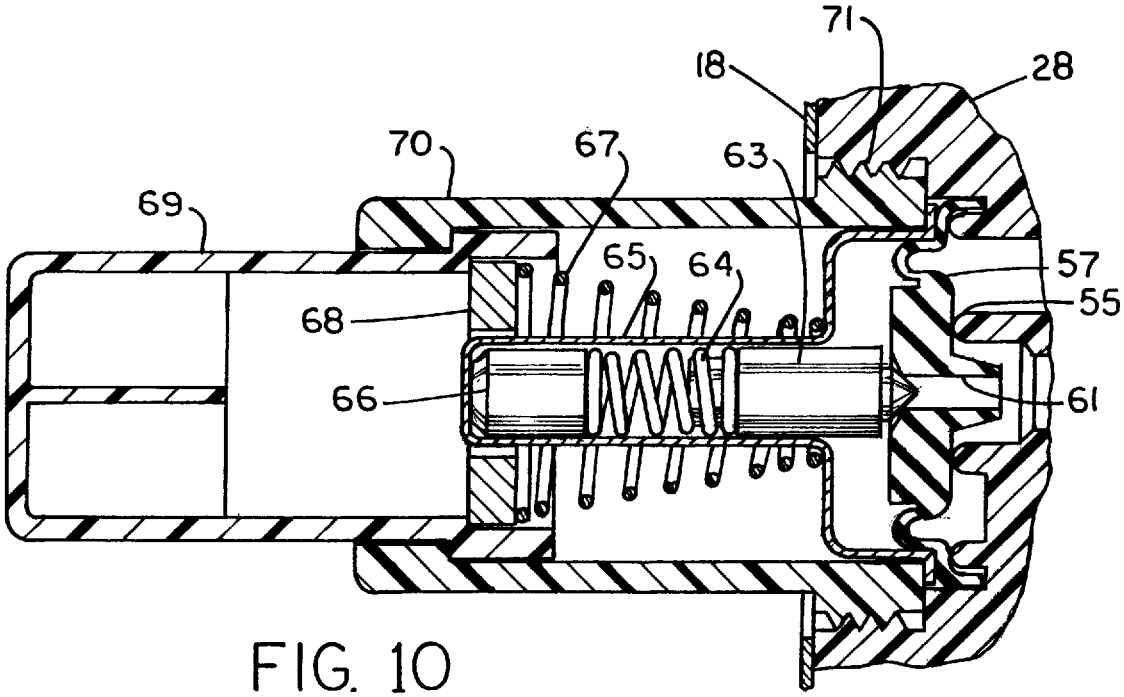
FIG. 10 is a view in cross-section of the valve member shown in FIG. 9 in a closed portion.
Figure 11:
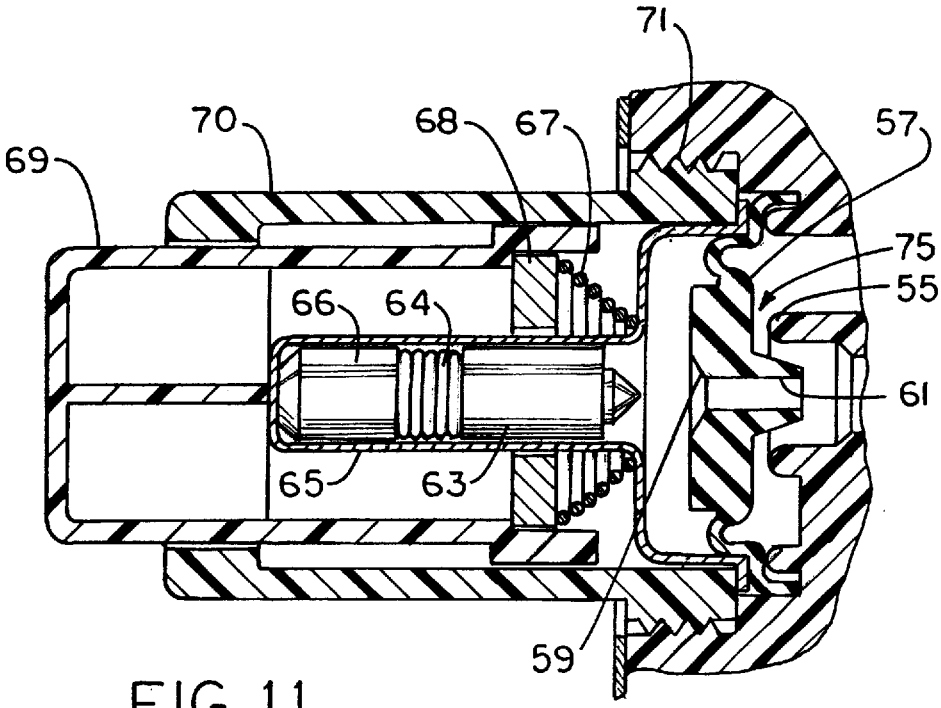
FIG. 11 is a view similar to FIG. 10 showing the valve member in an open position.

FIGS. 9, 10 and 11 depict the valve members 32B, L, R and G which are all of the same construction. This valve is of the magnetic actuated type and is available from Dema Engineering Company in St. Louis, Mo. It operates in conjunction with the valve seat 55 which is part of the valve body 28. It includes a diaphragm 57 having a pocket 59, with an orifice 61. A plunger 63 is constructed to seat in the pocket 59 in one position. A spring 64 biases the plunger 63 toward the diaphragm 57 and in a closed position of the valve as seen in FIG. 10. Plunger housing 65 accommodates the plunger 63, the spring 64 and the insert 66. Spring 67 extends over the plunger housing 65 and biases the magnet 68 against the button 69 and the button against the valve housing 70. Valve housing 70 is attached to the valve body 28 by the threads 71. In order to allow flow of water through the valve body 28 and to the eductors 37 and 38, the button 69 is pressed inwardly as shown in FIG. 11, this moves the magnet 68 in the direction of the plunger 63 to magnetically attract the metal plunger 63 drawing it away from diaphragm 57. This allows water pressure to unseat the diaphragm 57, thus allowing water to flow in the direction of directional arrow 75.

Although not shown in the drawings, a ball check valve is located in the caps 47B, L, R and G to prevent forward siphoning of concentrate from the containers 24B, L, R or G when the valves 32B, L, R and G are in a closed position.

An important feature of this invention is the aspect that the caps 47B, L, R and G, the containers 24B, L, R and G, the valve members 32B, L, R and G are color coordinated so that the chance of any mistake in dispensing solutions is substantially reduced. For example, in this instance, the containers 24B, L, R and G will have labels such as a black label 26B on container 24B, a blue label 26L on container 24L, a red label 26R on container 24R and a green label 26G on container 24G. These will match with the color coded valve members 32B, L, R and G which will also be color coded black, blue, red and green, respectively. In addition, there are the label panels 15B, 15L, 15R and 15G which are also color-coded black, blue, red, and green, respectively. It should also be noted that they are also of a different geometric pattern. In addition, outlet hoses 50B, L, R and G are also color-coded black, blue, red and green respectively. An example of the different products to be dispensed from dispensing apparatus 10 would be a floor cleaner from container 24B, a glass and multi-surface cleaner from container 24L, a degreaser and label remover from container 24R and a disinfectant cleaner from container 24G. Thus by color coordinating the containers with concentrate with the caps, valves, the panel labels and the outlet hoses any mistakes in connecting the wrong container with the wrong outlet hose or solution container is substantially reduced.

Another important feature is the ease by which bottles or other solution containers can be filled from outlet hoses 50L, 50R and 50G. Ready access is provided at any suitable height.

Still another important feature is in the maintenance of the valve members 32B, L, R and G. As shown in FIG. 1 they extend though the apertures 36 in the front panel 18. This affords easy removal in case of repair.

While the operation of the multistation liquid mixing and dispensing apparatus 10 should be apparent from the previous description, a brief description is given. The operator will attach the appropriately colored cap 47B, L, R and G to the appropriate container 24 as indicated by the labels 26B, L, R and G. These containers arc placed in rack 23 so that they are color aligned with valve members 32B, L, R and G, panel labels 15B, L, R and G and outlet hoses 50B, L, R and G. This is best seen in FIG. 2. A water supply hose will have been connected to hose connection 31. A suitable container will, for example, be placed under outlet hose 50L. The button 69 of valve member 32L will be depressed which allows water to flow through valve body 28 and to eductor 37. This creates a siphoning action in liquid supply line 42L to siphon the contents of container 24L with the blue label 26L into the eductor 37 where it will mix with the water and be dispensed as a solution through outlet hose 50L. As long as the button 69 is depressed the previously described mixing will continue. A release of the button 69 will stop the flow of water and mixing as indicated previously in conjunction with FIG. 10.

The mixing in apparatus 10 has been described in conjunction with four different solution containers, valves and outlet hoses, it will be appreciated that the color coordination feature as well as the placement of the containers above eductors for easier access to the outlet hoses could be operable with as few as two concentrate containers or any practical number in excess of four. Certain colors have been designated for matching the containers with the dispensing hoses in the mixing and dispensing apparatus. These can be modified and other different colors substituted. Further while one larger hose 50B has been described, more than one could be employed. All such and other modifications within the spirit of the invention are meant to be within its scope as defined by the appended claims.

What is claimed is:

1. A multistation liquid mixing and dispensing apparatus comprising:

a support member;

a plurality of containers placed on the support member;

a plurality of valve members and eductors positioned below the containers;

a liquid intake manifold connected to the valve members and the eductors;

a liquid product supply line operatively connected to each container and a liquid product intake of the eductor;

a cap member connected to each container and each liquid supply line;

a liquid outlet line operatively connected to each valve member and eductor;

wherein each of the containers, valve members and liquid outlet lines are color-coded.

2. The multistation liquid mixing and dispensing apparatus as defined in claim 1, wherein the containers have labels which are color-coded to the valve members and liquid outlet lines.

3. The multistation liquid mixing and dispensing apparatus as defined in claim 1, wherein the liquid outlet lines are flexible hoses of different colors.

4. The multistation liquid mixing and dispensing apparatus as defined in claim 1, wherein one of the liquid outlet lines is of a longer length than the others.

5. The multistation liquid mixing and dispensing apparatus as defined in claim 1, wherein the support member is defined by an open shelf.

6. The multistation liquid mixing and dispensing apparatus as defined in claim 1, further including a panel member for supporting the eductors and the valve members with the valve members extending through the panel for access thereto.

7. The multistation liquid mixing and dispensing apparatus as defined in claim 1, wherein the liquid outlet lines are positioned at a bottom of the support member.

8. The multistation liquid mixing and dispensing apparatus as defined in claim 1, wherein the cap member is color-coded to the containers, valve members, a panel member and liquid outlet lines.

* * * * *